US006439527B1

(12) United States Patent
Lin

(10) Patent No.: US 6,439,527 B1
(45) Date of Patent: Aug. 27, 2002

(54) FITTING FOR HOLDING AN UPRIGHT SUSPENSION ROD TO A CEILING WALL

(76) Inventor: Hsiu-Chen Lin, No. 55, Lane 115, Fu-Min Rd., Hsi-Chou Tsun, Shen-Kang Hsiang, Taichung Hsien (TW)

( * ) Notice: Subject to any disclaimer, the term of this patent is extended or adjusted under 35 U.S.C. 154(b) by 74 days.

(21) Appl. No.: 09/629,406

(22) Filed: Aug. 1, 2000

(51) Int. Cl.[7] ..... B42F 13/00

(52) U.S. Cl. ..... 248/343; 248/222.52; 248/317; 248/342; 416/5; 416/244 R

(58) Field of Search ..... 248/342, 343, 248/344, 222.52, 223.41, 317; 416/244 R, 5, 214 R, 210 R; 403/348, 350; 439/537, 140, 316

(56) References Cited

U.S. PATENT DOCUMENTS

| | | | | | |
|---|---|---|---|---|---|
| 4,448,388 | A | * | 5/1984 | Dennis et al. | 248/344 X |
| 5,090,654 | A | * | 2/1992 | Riddings et al. | 248/33 |
| 5,507,619 | A | * | 4/1996 | Ryan | 416/5 |
| 5,568,969 | A | * | 10/1996 | Yu | 362/404 |
| 5,725,190 | A | * | 3/1998 | Cuthbertson et al. | 248/343 |
| 5,851,107 | A | * | 12/1998 | Wang | 416/244 R |
| 5,947,438 | A | * | 9/1999 | Bucher et al. | 248/345 |
| 6,042,072 | A | * | 3/2000 | Chi-Nan | 248/343 |
| 6,146,191 | A | * | 11/2000 | Kerr, Jr. et al. | 439/537 |
| 6,250,885 | B1 | * | 6/2001 | Gajewski | 416/214 R |
| 6,280,145 | B1 | * | 8/2001 | Liu | 416/244 R |

* cited by examiner

*Primary Examiner*—Anita King
*Assistant Examiner*—Tan Le
(74) *Attorney, Agent, or Firm*—Townsend and Townsend and Crew LLP

(57) ABSTRACT

A fitting includes a mounting frame to be fixed on a ceiling wall, and having right and left anchored walls for holding an upright suspension rod which is connected to a fan motor casing. A protective cover member includes an annular abutment wall secured on the anchored walls by two fastening members. Each fastening member includes an enlarged head, a distal shank portion, and a proximate shank portion larger than the distal shank portion so as to form an abutment shoulder to abut against the annular abutment wall. An annular shield member has two insert grooves for insertion of the enlarged heads of the fastening members longitudinally, and two clamping grooves communicated with and extending from the insert grooves in one of clockwise and counterclockwise directions such that a subsequent rotation of the annular shield member relative to the annular abutment wall of the protective cover member, which is guided by the proximate shank portions respectively along the clamping grooves, will bring the enlarged heads to be retained respectively in the clamping grooves. As such, the securing operations of the protective cover member and the annular shield member on the mounting frame are convenient to conduct.

5 Claims, 6 Drawing Sheets

FITTING FOR HOLDING AN UPRIGHT SUSPENSION ROD TO A CEILING WALL

BACKGROUND OF THE INVENTION

1. Field of the Invention

This invention relates to a ceiling fan, more particularly to a fitting for holding an upright suspension rod, which extends from a fan motor casing, to a ceiling wall.

2. Description of the Related Art

Referring to FIG. 1, a conventional ceiling fan 1 is shown to include a mounting frame 21 which has right and left anchoring members 211 for mounting on a ceiling wall 10 by screw fasteners 22, and right and left arm members 213 that extend downwardly for holding an upright suspension rod 23 connected to a motor casing (not shown). An outer edge portion of each of the right and left anchoring members 211 has a screw hole 212. A protective cover member 24 has an upper annular secured portion 241 formed with through holes such that screw fasteners 25 can pass through the through holes and engage threadedly the screw holes 212 to tighten the protective cover member 24 on the mounting frame 21. The protective cover member 24 has a skirt portion 243 which extends downwardly from the upper annular secured portion 241 to confine a central opening 242 for passage of the upright suspension rod 23. In order to conceal the screw fasteners 25, an annular metal member 261 and an annular plastic shield member 262 are provided to cover the upper annular secured portion 241 in such a manner that the screw fasteners 25 are inserted into engaging grooves 263 in the plastic shield member 262 from openings 264.

However, the securing operation of the upper annular secured portion 241 of the protective cover member 24 on the mounting frame 21 is inconvenient to conduct after the mounting frame 21 has been secured to the ceiling wall 10 since the upper annular secured portion 241 is closed to the ceiling wall 10. In addition, the annular metal member 261 and the plastic shield member 262 are needed to cover the entire upper annular secured portion 241, thereby resulting in a relative large material requirement.

SUMMARY OF THE INVENTION

The object of the present invention is to provide a fitting which can facilitate assembly of a protective cover member and an annular shield member to a mounting frame of a ceiling fan.

According to this invention, the fitting includes a mounting frame which has right and left anchoring members spaced apart from each other with a first width in a transverse direction, and adapted to be fixed on a ceiling wall. Each of the right and left anchoring members has first inner and outer edge portions opposite to each other in the transverse direction. The mounting frame further has right and left arm members which respectively extend from the first inner edge portions of the right and left anchoring members downwardly and in a longitudinal direction transverse to the transverse direction to form right and left jaw portions spaced apart from each other. The right and left jaw portions are provided respectively with right and left anchored walls, each of which extends in the transverse direction and includes second inner and outer edge portions opposite to each other in the transverse direction. The second inner edge portions of the right and left anchored walls define a second width shorter than the first width so as to be adapted to hold an upright suspension rod. Each of the right and left anchored walls defines a fastening bore therein which extends in the longitudinal direction. A protective cover member includes an annular abutment wall which confines a central opening adapted for passage of the upright suspension rod, and which is disposed beneath the right and left anchored walls. The annular abutment wall defines a pair of through holes which are registered with the fastening bores, respectively. The protective cover member further includes a skirt portion which extends circumferentially from the annular abutment wall and towards the ceiling wall, and outwardly so as to flank the first outer edge portions, thereby concealing the mounting frame. A pair of fastening members are oriented in an axial direction. Each fastening member includes an enlarged head with a thickness in the axial direction, a distal shank portion of a first dimension, and a proximate shank portion interposed therebetween and being of a second dimension which is larger than the first dimension so as to form an abutment shoulder between the proximate and distal shank portions. As such, when the fastening members are respectively brought to be inserted into the fastening bores to fasten the annular abutment wall onto the right and left anchored walls, the abutment shoulders of the fastening members abut against the annular abutment wall. An annular shield member includes upper and lower annular walls spaced apart from each other in the longitudinal direction. The upper annular wall has a pair of insert grooves diametrically opposed to each other, and each of such a dimension as to accommodate the enlarged head of a respective one of the fastening members in the longitudinal direction when the axial direction is oriented to conform to the longitudinal direction. The upper annular wall further has a pair of clamping grooves which are communicated with and which extend from the insert grooves in one of clockwise and counterclockwise directions. Once the insert grooves have been brought to receive the enlarged heads in the longitudinal direction respectively, a subsequent rotation of the upper annular wall of the annular shield member relative to the annular abutment wall of the protective cover member, which is guided by the proximate shank portions respectively along the clamping grooves, will bring the enlarged heads to be retained respectively in the clamping grooves.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
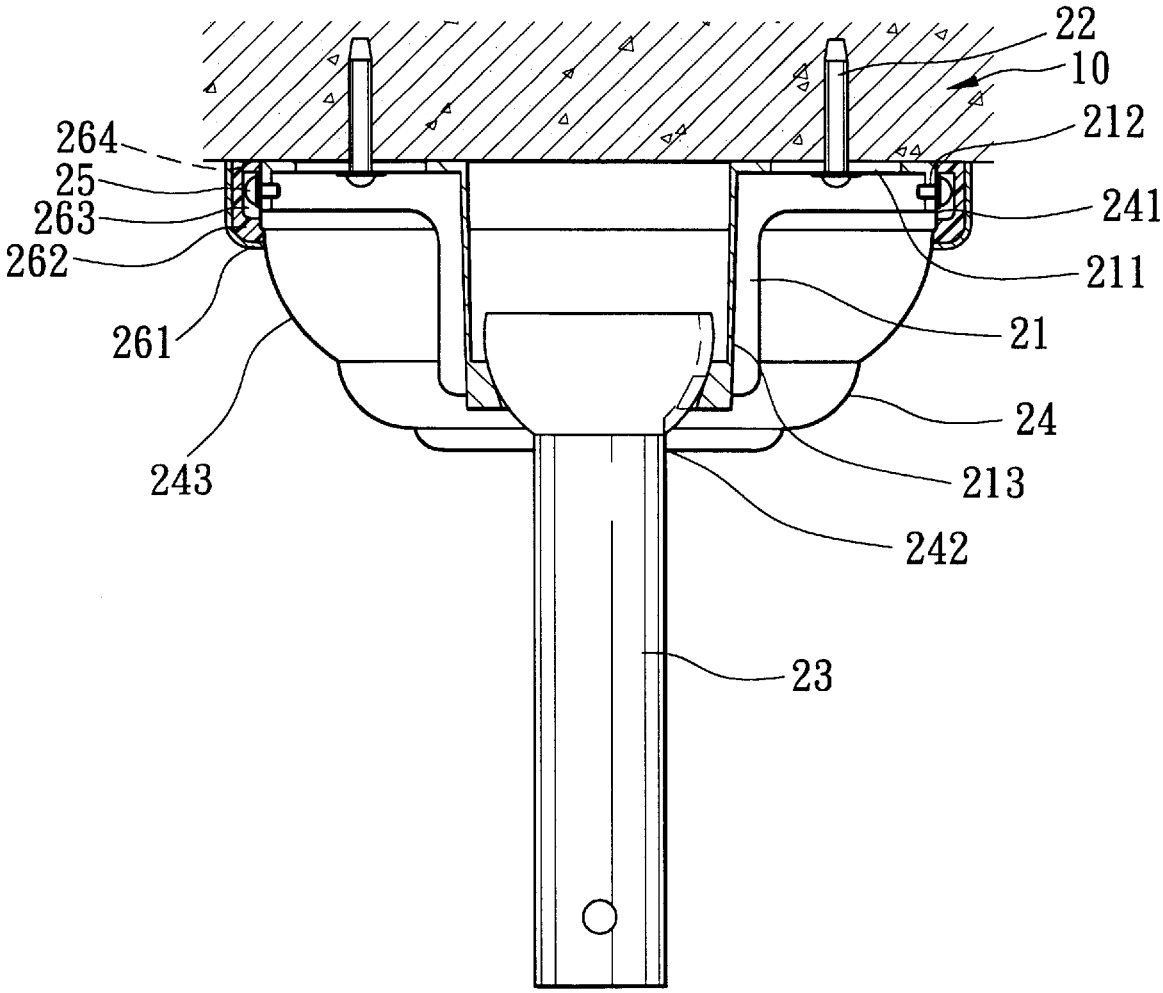
FIG. 1 PRIOR ART
FIG. 1 is a sectional view of a portion of a conventional ceiling fan.
Figure 2:
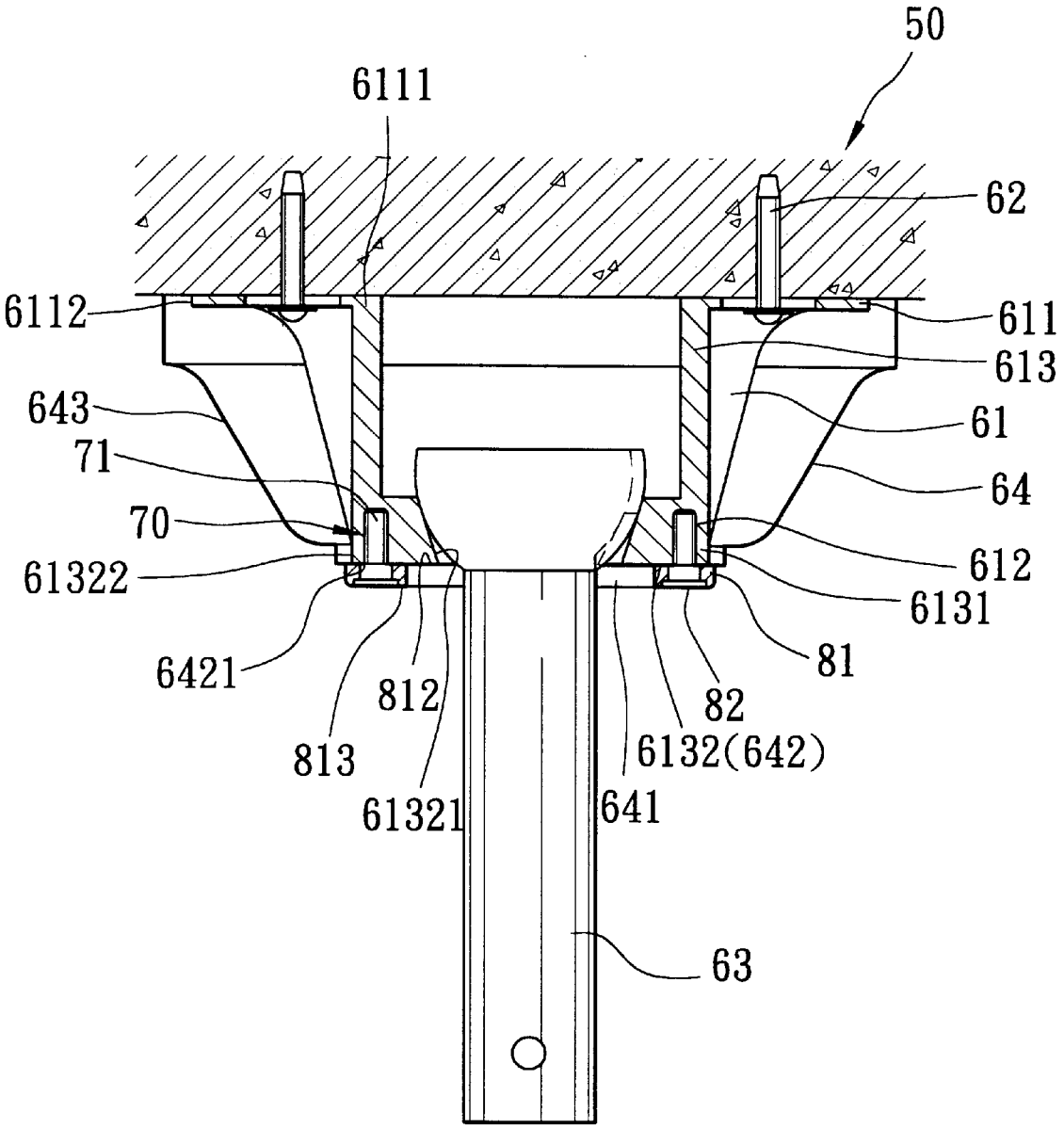
FIG. 2 is a sectional view of a preferred embodiment of a fitting according to this invention.

Referring to FIG. 2, the preferred embodiment of the fitting according to the present invention is shown to comprise a mounting frame 61, a protective cover member 64, a pair of fastening members 70, and an annular shield member 81.

The mounting frame 61 includes right and left anchoring members 611 which are spaced apart from each other with a first width in a transverse direction, and which are adapted to be fixed on a ceiling wall 50 by means of a pair of screw fasteners 62. Each of the right and left anchoring members 611 has first inner and outer edge portions 6111,6112 opposite to each other in the transverse direction. Right and left arm members 613 respectively extend from the first inner edge portions 6111 of the right and left anchoring members 611 downwardly and in a longitudinal direction transverse to the transverse direction to form right and left jaw portions 6131 which are spaced apart from each other. The right and left jaw portions 6131 are provided respectively with right and left anchored walls 6132, each of which extends in the transverse direction and includes second inner and outer edge portions 61321,61322 opposite to each other in the transverse direction. The second inner edge portions 61321 of the right and left anchored walls 6132 define a second width shorter than the first width so as to be adapted to hold an upright suspension rod 63 that extends from a fan motor casing (not shown). Each of the right and left anchored walls 6132 defines a fastening bore 612 therein which extends in the longitudinal direction. In this preferred embodiment, the fastening bores 612 are screw bores.

The protective cover member 64 includes an annular abutment wall 642 which confines a central opening 641 that is adapted to accommodate passage of the upright suspension rod 63, and which extends in the transverse direction and which is disposed beneath the right and left anchored walls 6132. The annular abutment wall 642 defines a pair of through holes 6421 which are registered with the fastening bores 612, respectively. A skirt portion 643 extends circumferentially from the annular abutment wall 642 and towards the ceiling wall 50, and outwardly so as to flank the first outer edge portions 6112 of the right and left anchoring members 611, thereby concealing the mounting frame 61.

Figure 3:
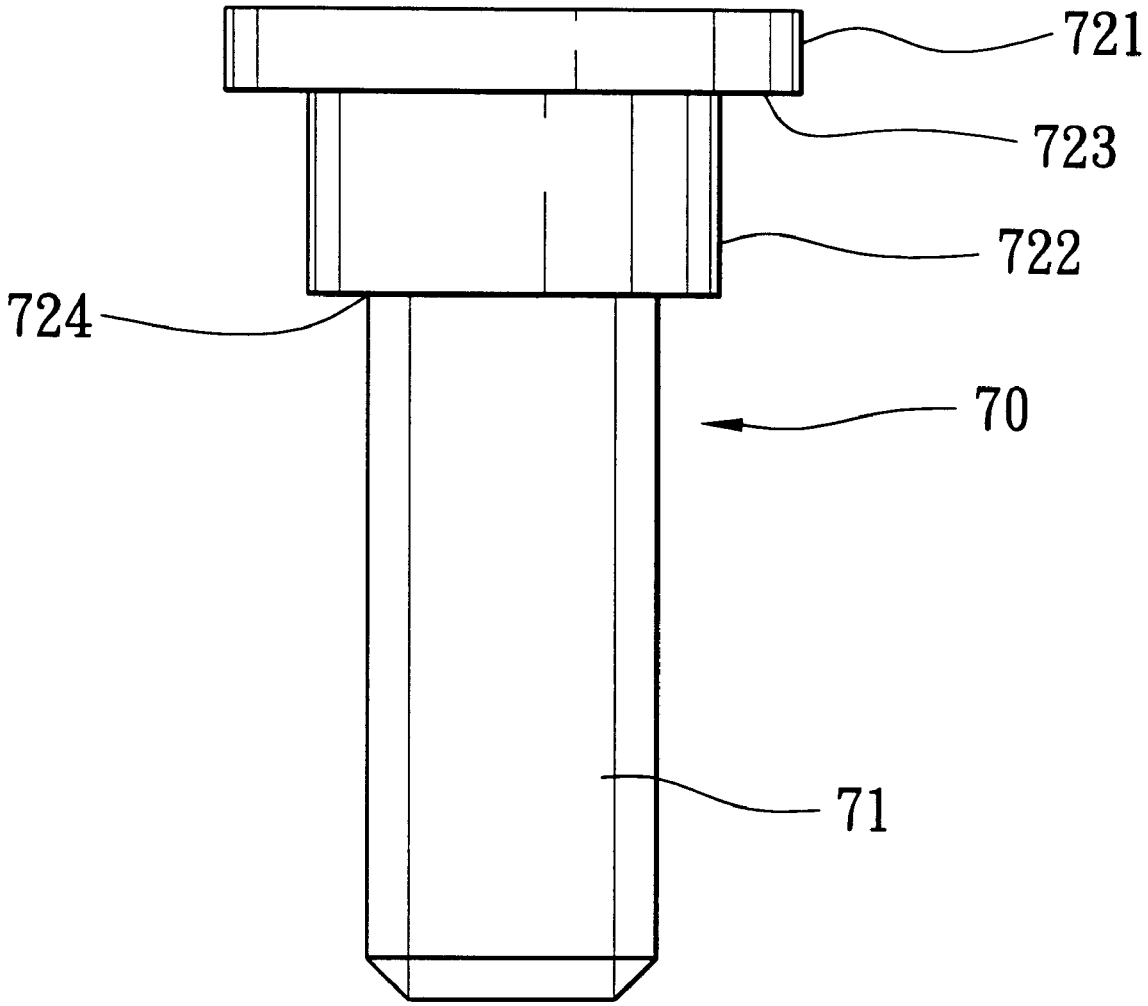
FIG. 3 is a side view of a fastening member of the preferred embodiment.

With reference to FIG. 3, each fastening member 70 is oriented in an axial direction, and includes an enlarged head 721 with a thickness in the axial direction, a distal shank portion 71 of a first dimension, and a proximate shank portion 722 which is interposed between the enlarged head 721 and the distal shank portion 71, and which is of a second dimension that is larger than the first dimension so as to form an abutment shoulder 724 between the shank portions 722, 71. An anchoring shoulder 723 is defined between the enlarged head 721 and the proximate shank portion 722. Therefore, when the fastening members 70 are respectively brought to be inserted into the fastening bores 612 to fasten the annular abutment wall 642 onto the right and left anchored walls 6132, the abutment shoulders 724 of the fastening members 70 abut against the annular abutment wall 642.

Figure 4:
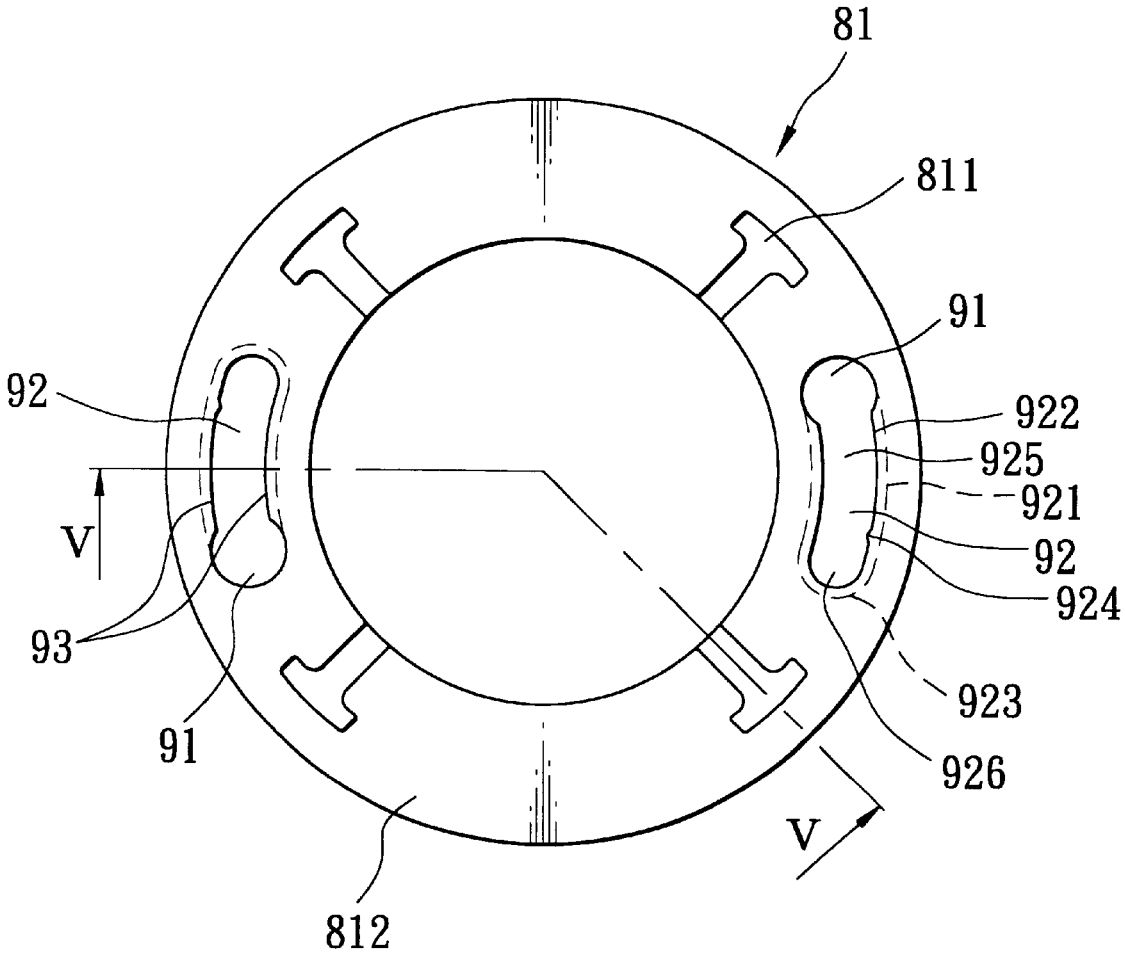
FIG. 4 is a top view of a protective cover member of the preferred embodiment.
Figure 5:
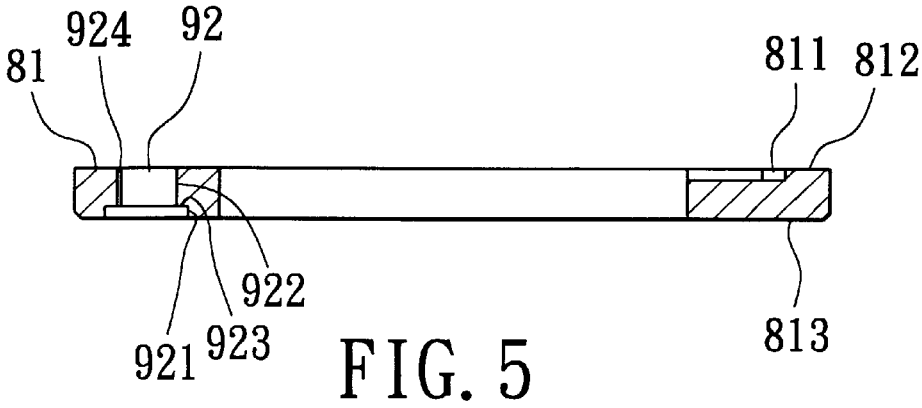
FIG. 5 is a cross-sectional view of the protective cover member shown in FIG. 4, taken along lines V—V thereof.

With reference to FIGS. 2, 4 and 5, the annular shield member 81 is made of a plastic material, and includes upper and lower annular walls 812,813 which are spaced apart from each other in the longitudinal direction. The upper annular wall 812 includes a pair of insert grooves 91 which are diametrically opposed to each other, and each of which is of such a dimension as to accommodate the enlarged head 721 of a respective one of the fastening members 70 in the longitudinal direction when the axial direction is oriented to conform to the longitudinal direction. A pair of clamping grooves 92 are communicated with and extend from the insert grooves 91 respectively in one of clockwise and counterclockwise directions. More particularly, the upper annular wall 812 of the annular shield member 81 defines two pairs of clamping edge portions 93. The clamping edge portions 93 in each pair extend downwardly in the longitudinal direction to communicate with the lower annular wall 813, and are disposed parallel to and are spaced apart from each other to confine a respective one of the clamping grooves 92. Each pair of the clamping edge portions 93 includes a pair of upper sections 922 which define a first distance so as to permit the proximate shank portion 722 of a respective one of the fastening members 70 to slide therebetween, and a pair of enlarged lower sections 921 which are respectively opposite to the upper sections 922 in the longitudinal direction and which define a second distance that is larger than the first distance so as to form a pair of anchored shoulders 923 between the upper and enlarged lower sections 922,921. Each pair of the clamping edge portions 93 has a limiting protrusion 924 which is formed thereon to partition the respective clamping groove 92 into a positioning groove portion 926 and a guiding groove portion 925 respectively distal and proximate to the respective insert groove 91.

Therefore, when the annular shield member 81 is mounted on the annular abutment wall 642 of the protective cover member 64, the insert grooves 91 of the annular shield member 81 are brought to receive the enlarged heads 721 of the fastening members 70 in the longitudinal direction, respectively. A subsequent rotation of the upper annular wall 812 relative to the annular abutment wall 642 of the protective cover member 64, which is guided by the proximate shank portions 722 respectively along the clamping edge portions 93, will bring the enlarged heads 721 to be retained respectively in the positioning groove portions 926 of the clamping grooves 92. At the same time, the anchoring shoulders 723 of the fastening members 70 abut against the anchored shoulders 923 of the respective pair of the clamping edge portions 93 during the rotation.

Figure 6:
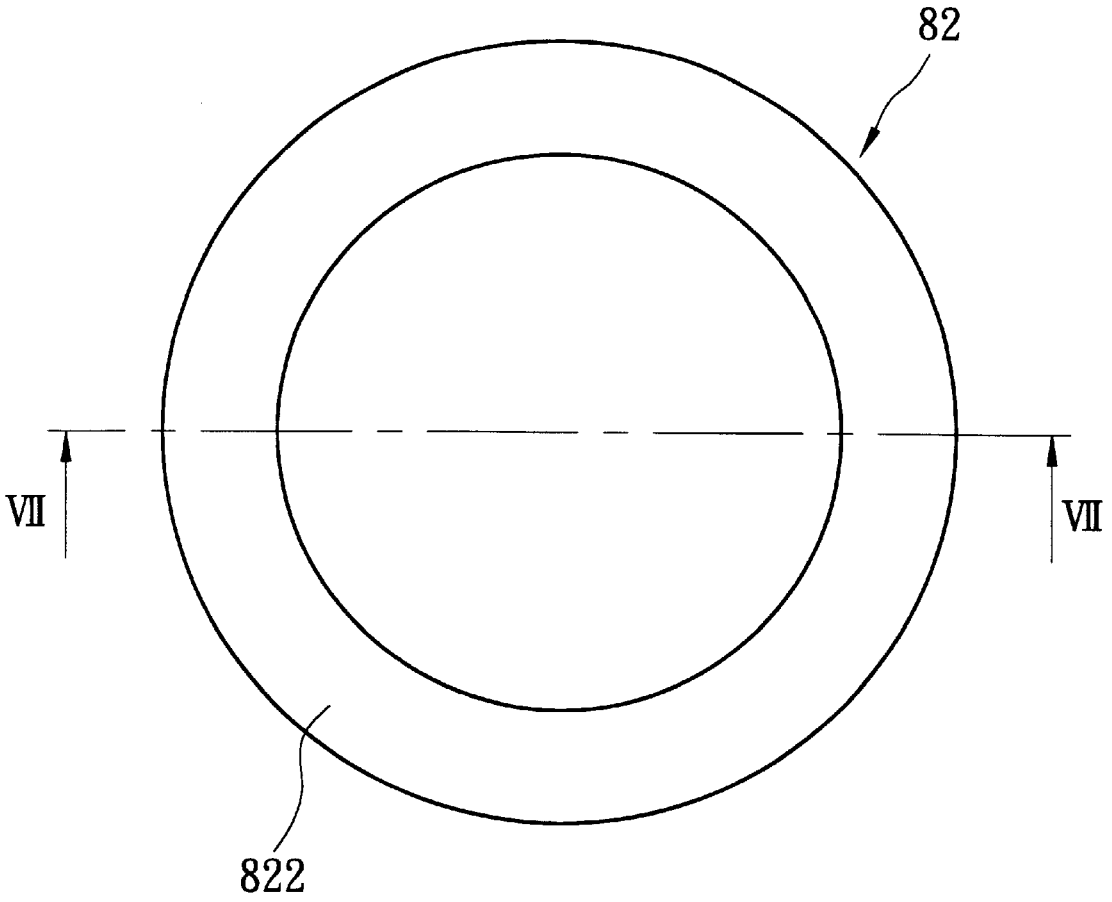
FIG. 6 is a bottom view of an annular metal member of the preferred embodiment.
Figure 7:
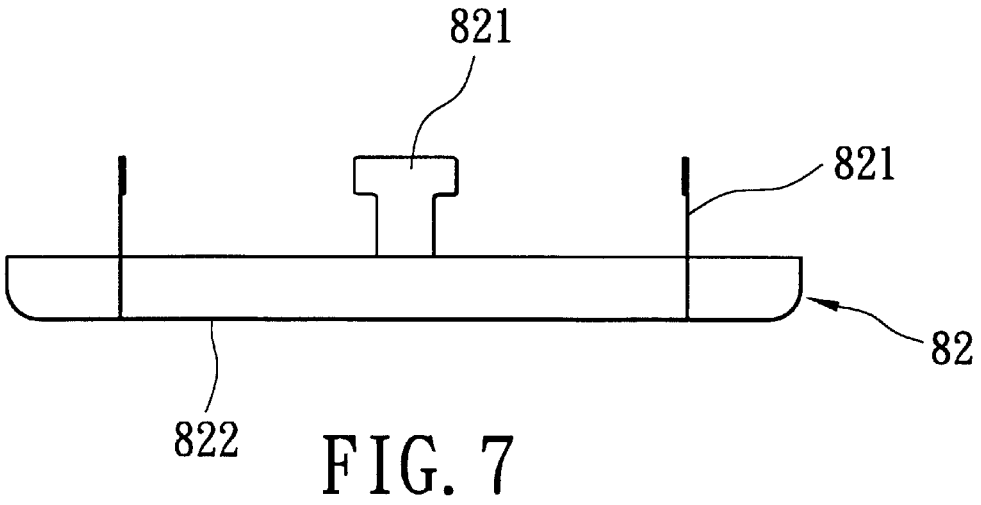
FIG. 7 is a cross-sectional view of the annular metal member shown in FIG. 6, taken along lines VII—VII thereof.
Figure 8:
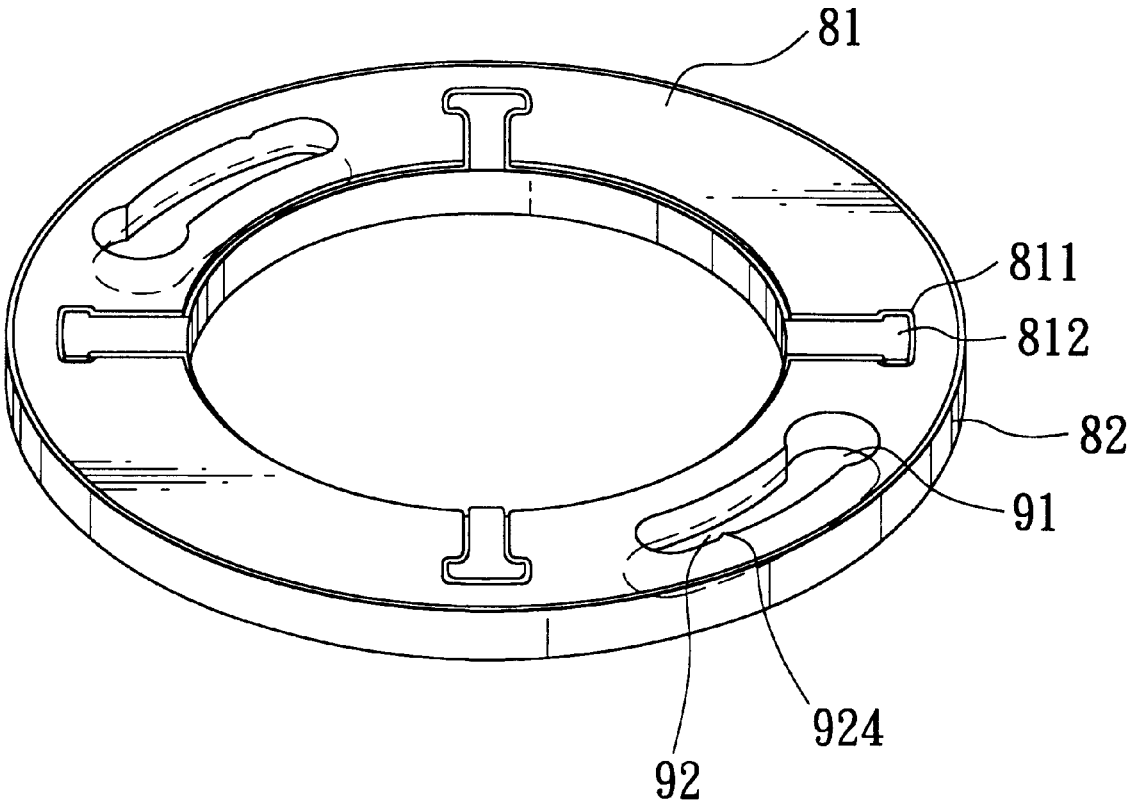
FIG. 8 is a perspective view showing the annular metal member when mounted on the protective cover member.

Preferably, referring to FIGS. 4, 6 and 7, the upper annular wall 812 of the annular shield member 81 defines a plurality of T-shaped engaging recesses 811 which are formed therein and which are angularly displaced from one another. In order to conceal the fastening members 70, an annular metal member 82 is provided, and includes an annular plate portion 822 which is disposed underneath the annular shield member 81 in the longitudinal direction, and a plurality of T-shaped engaging lugs 821 which are disposed to be angularly displaced from one another to mate respectively with the engaging recesses 811 of the annular shield member 81 and which extend upwardly from the annular plate portion 822. As such, with reference to FIG. 8, the engaging lugs 821 can protrude inwardly and upwardly of and can be bent towards the upper annular wall 812 of the annular shield member 81 so as to be inserted into and retained within the engaging recesses 811 such that the engaging lugs 821 are flush with the upper annular wall 812 of the annular shield member 81.

As illustrated, the fastening members 70 are brought to secure the annular abutment wall 642 of the protective cover member 64 on the right and left anchored walls 6132 of the mounting frame 61 without contacting the ceiling wall 50, thereby resulting in convenience during the securing operation of the fastening members 70. In addition, the annular shield member 81 is mounted on the annular abutment wall 642 of the protective cover member 64 by inserting the enlarged heads 721 of the fastening members 70 into the insert grooves 91 and by rotating the annular shield member 81 relative to the protective cover member 64 so as to retain the enlarged heads 721 in the positioning groove portions 926. Thus, the mounting operation of the annular shield member 81 is convenient to conduct. Moreover, the annular shield member 81 and the annular metal member 82 can reinforce the protective cover member 64 at the central opening 641.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

I claim:

1. A fitting for holding an upright suspension rod, which extends from a motor casing, to a ceiling wall, said fitting comprising:

a mounting frame including right and left anchoring members spaced apart from each other with a first width in a transverse direction, and adapted to be fixed on the ceiling wall, each of said right and left anchoring members having first inner and outer edge portions opposite to each other in the transverse direction, and right and left arm members respectively extending from said first inner edge portions of said right and left anchoring members downwardly and in a longitudinal direction transverse to the transverse direction to form right and left jaw portions spaced apart from each other, and provided respectively with right and left anchored walls, each of which extends in the transverse direction and includes second inner and outer edge portions opposite to each other in the transverse direction, said second inner edge portions of said right and left anchored walls defining a second width shorter than said first width so as to be adapted to hold the upright suspension rod, each of said right and left anchored walls defining a fastening bore therein which extends in the longitudinal direction;

a protective cover member including an annular abutment wall confining a central opening adapted to accommodate passage of the upright suspension rod, and extending in the transverse direction and disposed beneath said right and left anchored walls, said annular abutment wall defining a pair of through holes which are registered with said fastening bores, respectively, and a skirt portion extending circumferentially from said annular abutment wall and towards the ceiling wall, and outwardly so as to flank said first outer edge portions, thereby concealing said mounting frame;

a pair of fastening members, each oriented in an axial direction, and including an enlarged head with a thickness in the axial direction, a distal shank portion of a first dimension, and a proximate shank portion interposed between said enlarged head and said distal shank portion, and being of a second dimension which is larger than said first dimension so as to form an abutment shoulder between said proximate and distal shank portions such that when said fastening members are respectively brought to be inserted into said fastening bores to fasten said annular abutment wall onto said right and left anchored walls, said abutment shoulders of said fastening members abut against said annular abutment wall; and an annular shield member including upper and lower annular walls spaced apart from each other in the longitudinal direction, said upper annular wall including a pair of insert grooves diametrically opposed to each other, and each of such a dimension as to accommodate said enlarged head of a respective one of said fastening members in the longitudinal direction when the axial direction is oriented to conform to the longitudinal direction, and a pair of clamping grooves communicated with and extending from said insert grooves in one of clockwise and counterclockwise directions such that once said insert grooves have been brought to receive said enlarged heads in the longitudinal direction respectively, a subsequent rotation of said upper annular wall of said annular shield member relative to said annular abutment wall of said protective cover member, which is guided by said proximate shank portions respectively along said clamping grooves, will bring said enlarged heads to be retained respectively in said clamping grooves.

2. The fitting as claimed in claim 1, wherein said upper annular wall of said annular shield member defines a plurality of engaging recesses formed therein and angularly displaced from one another, said fitting further comprising an annular metal member which includes an annular plate portion disposed underneath said annular shield member in the longitudinal direction, and a plurality of engaging lugs disposed to be angularly displaced from one another to mate respectively with said engaging recesses, to extend upwardly from said annular plate portion, and to protrude inwardly and upwardly of and to be bendable towards said upper annular wall of said annular shield member so as to be inserted into and retained within said engaging recesses such that said engaging lugs are flush with said upper annular wall of said annular shield member.

3. The fitting as claimed in claim 2, wherein each of said engaging recesses and said engaging lugs is of a T-shape.

4. The fitting as claimed in claim 1, wherein each of said fastening members further has an anchoring shoulder defined between said enlarged head and said proximate shank portion;

said upper annular wall of said annular shield member defining two pairs of clamping edge portions, each pair of said clamping edge portions extending downwardly in the longitudinal direction to communicate with said lower annular wall, and being disposed parallel to and spaced apart from each other to confine a respective one of said clamping grooves, said pair of said clamping edge portions including a pair of upper sections defining a first distance so as to permit said proximate shank portion of a respective one of said fastening members to slide therebetween, and a pair of enlarged lower sections respectively opposite to said upper sections in the longitudinal direction and defining a second distance which is larger than the first distance so as to form a pair of anchored shoulders between said upper and enlarged lower sections such that said anchoring shoulder of each of said fastening members abuts against said anchored shoulders of a respective pair of said clamping edge portions during the subsequent rotation of said upper annular wall relative to said annular abutment wall.

5. The fitting as claimed in claim 4, wherein one of said pairs of said clamping edge portions has a limiting protrusion formed thereon to partition said respective one of said clamping grooves into a positioning groove portion and a guiding groove portion respectively distal and proximate to said respective one of said insert grooves such that said respective one of said fastening members slides to and is limited in said positioning groove portion after the rotation of said upper annular wall of said annular shield member relative to said annular abutment wall of said protective cover member.

* * * * *